US007854188B1

(12) United States Patent
Buckley

(10) Patent No.: US 7,854,188 B1
(45) Date of Patent: Dec. 21, 2010

(54) CALIBRATED TAPER CRIMP DIE

(76) Inventor: Thomas Bruce Buckley, P.O. Box 5246, Lacey, WA (US) 98509-5246

( * ) Notice: Subject to any disclaimer, the term of this patent is extended or adjusted under 35 U.S.C. 154(b) by 0 days.

(21) Appl. No.: 12/660,279

(22) Filed: Feb. 24, 2010

Related U.S. Application Data

(62) Division of application No. 11/288,851, filed on Nov. 29, 2005, now Pat. No. 7,681,481.

(51) Int. Cl.
*F42B 33/12* (2006.01)

(52) U.S. Cl. ..... 86/41; 86/39

(58) Field of Classification Search ..... 86/23, 86/25, 28, 36, 37, 39, 40, 41, 43
See application file for complete search history.

(56) References Cited

U.S. PATENT DOCUMENTS

| | | | | | |
|---|---|---|---|---|---|
| 1,550,284 | A * | 8/1925 | Schmitt | 86/23 |
| 1,864,880 | A * | 6/1932 | Zimmerman | 86/37 |
| 2,700,915 | A * | 2/1955 | Pattison | 86/39 |
| 3,345,904 | A * | 10/1967 | Kleiss | 86/25 |
| 3,745,875 | A * | 7/1973 | Kennedy | 86/23 |
| 4,189,980 | A * | 2/1980 | Schaenzer | 86/24 |
| 4,336,739 | A * | 6/1982 | Alexander | 86/43 |
| 4,385,546 | A * | 5/1983 | Lee | 86/36 |
| 4,593,598 | A | 6/1986 | Gunder | |
| 4,637,291 | A * | 1/1987 | Alexander | 86/23 |
| 4,836,078 | A * | 6/1989 | Lee | 86/24 |
| 4,862,567 | A * | 9/1989 | Beebe | 86/43 |
| 4,869,148 | A * | 9/1989 | Tucker | 86/43 |
| 5,079,986 | A * | 1/1992 | Lee | 86/39 |
| 5,635,661 | A | 6/1997 | Tuftee | |
| 5,649,465 | A | 7/1997 | Beebe | |
| 6,397,720 | B1 | 6/2002 | Fox et al. | |
| 7,703,369 | B1 * | 4/2010 | Lee | 86/43 |
| 2002/0157524 | A1 * | 10/2002 | Tuftee | 86/23 |

OTHER PUBLICATIONS

Lee Carbide Factory Crimp Die Instructions (one sheet); authored by Lee Precision, Inc., 4275 Highway U, Hartford, Wisconsin.
Catalog: "Lee Reloading 2010" by Lee Precision, Inc. (same address; see, in particular, p. 3: "Lee Carbide Factory Crimp Die."

* cited by examiner

*Primary Examiner*—Troy Chambers
(74) *Attorney, Agent, or Firm*—Brian J. Coyne

(57) ABSTRACT

An ammunition case reloading die assembly, and method of use, that provides calibrated adjustment of taper imposed on the mouth of an ammunition case. A calibrating ring or cap bears indicia in the form of polygonal faces, splines or radially-directed markings. The ring or cap rotates with an upper portion of the die for threaded adjustment of the position of the die within the frame of a reloading press. The die has a longitudinal bore, a lower portion whereof is tapered for imposing a tapered crimp upon the mouth of the case. The taper of the longitudinal bore is preferably chosen to make each partial rotation of the calibrating ring or cap through one indicium correspond to increasing the taper imposed on the mouth by one thousandth of an inch per case longitudinal inch.

3 Claims, 14 Drawing Sheets

CALIBRATED TAPER CRIMP DIE

CROSS REFERENCE TO RELATED APPLICATIONS

This is a divisional of U.S. patent application Ser. No. 11/288,851, filed Nov. 29, 2005, now U.S. Pat. No. 7,681,481 B1.

STATEMENT REGARDING FEDERALLY APPROVED RESEARCH AND DEVELOPMENT

None.

BACKGROUND OF THE INVENTION

1. Field of the Invention

This invention relates to dies that are used in presses for loading and reloading military, sporting arms and industrial ammunition cartridges.

2. Background Art

The established method for reloading ammunition cartridges comprises the following steps: resizing the brass cartridge case to reestablish the original size for receiving the corresponding type and size of bullet; depriming the case; expanding and/or flaring the case neck; repriming the cartridge with a fresh primer; refilling the case with propellant (black powder or smokeless gunpowder); inserting the bullet to the prescribed depth within the case, and crimping the bullet in the case mouth. Dies corresponding to these steps are customarily screwed into the head of an ammunition reloading press. A sizing and decapping die is screwed into the reloading press in alignment with a lever-driven ram that drives the case into the sizing and decapping die. The case neck is then expanded with the sizing and decapping die for most rifle cases, but using a combination flaring and expanding die in a separate operation for a pistol and for a straight-walled rifle case. Next, a bullet seating operation is performed using a bullet seating die and the process is completed by imposing a roll crimp on the mouth of the case. From the middle of the $19^{th}$ century to the present, cartridges that needed to be crimped were roll crimped in place to secure the bullet from movement within the case, either from recoil or the cartridge feeding process. In the middle 1970s, RCBS, Inc., of Oroville, Calif. invented the taper crimp die for use with rimless ammunition designed for semiautomatic pistols. Hence, in the case of ammunition for semiautomatic pistols, a taper crimp operation is performed on the reloaded case with a taper crimp die.

The present invention is directed to a die for imposing a taper crimp only. A taper crimp of appropriate degree serves to promote uniform burning of gun powder and provides improved accuracy; moreover, when imposed on ammunition for use in semiautomatic weapons, the taper crimp promotes better feed of cartridges through the weapon. The degree of taper is commonly expressed in thousandths of an inch of radial crimp per case axial inch, abbreviated "TPI." By planned and deliberate process, one can determine an optimal degree of taper crimp for a particular size and kind of ammunition, expressed in thousandths of an inch. The challenge then is to be able to reliably and repeatedly impose a prescribed degree of crimp upon reloaded ammunition cases.

Prior to my invention, no simple, reliable and repeatable method and no suitable taper crimp die existed for achieving that purpose.

SUMMARY OF THE INVENTION

The present invention provides a calibrated taper crimp die and method for using the same that reliably and repeatedly imposes a prescribed degree of crimp upon a reloaded ammunition case. The die comprises a shank having a regulating device in the form of a ring mounted on the shank at a first end and an internally tapered opening at a second, opposite end for receiving a reloaded case. The die has external threads and a threaded lock ring threadable thereon. In one embodiment, the external threads are ⅞ inch diameter by 14 threads per inch and the ring has an octagonal periphery—that is, the ring has eight, equal-sized, flat, machined faces symmetrically and radially disposed about the axis of the die. The head of a reloading press is provided with a bore with internal threads that are also ⅞ inch diameter by 14 threads per inch. Thus, when the die is threaded into the bore, starting from a zero point position as explained below, each one eighth turn of the die corresponds to imposition of one-eight of one-fourteenth inch axial (0.0089286 inch) advance of the die into the bore, which advance permits the imposition of a 0.112 taper per inch upon an aligned, loaded case seated in the case holder of the ram of the press, provided that the tapered opening of the die has a 0.112 taper per inch. Correspondingly, each one-eighth turn of the die past the zero point will cause an additional 0.0089286 X 0.112—one thousandth of an inch crimp in a radial inward direction to be imposed upon the mouth of a cartridge case when the ram of the press is actuated. In an alternative embodiment, the ring is hexagonal, the tapered opening in the die is 0.084 taper per inch, there are 14 threads per inch and ⅞ inch diameter die and bore, and each additional one-sixth turn of the die past the zero point advances the die into the bore 0.0119048 inch, which corresponds to imposition of two thousandths of an inch additional crimp. In further variations thereof, the ring alternatively has decagonal, or dodecagonal faces with corresponding adjustments to the taper of the tapered opening in the die. In a further embodiment, my die includes a regulating device in the form of a cylindrical spline, the splines serving as indicia of rotation of the die. In an alternative embodiment, the regulating device is in the form of a disk having radial grooves, said grooves serving as indicia of rotation of the die. In another embodiment, my die is adapted for imposing a calibrated taper crimp on a .50 Cal. BMG case. In still another embodiment, my invention includes a die having a floating crimper, such as the Lee Carbide Factory Crimp die, wherein a hexagonal cap is placed over and attached by a set to the knurled cap of the Lee Carbide Factory Crimp die, and the floating crimper of the Lee Carbide Factory Crimp die is designated to be 0.108 taper per inch. Each one-sixth turn of such a hexagonal cap past a zero point position corresponds to imposition of an additional one-thousandth of an inch crimp.

A method is provided for calibrating the die. A zero point position for the die body is established by performing the steps of threading a lock device onto a lower portion of the die body; holding the device stationary while threading the die body into a threaded bore of a head of an ammunition reloading press until the second end of the die body just contacts a brass cartridge case mouth having an inverted bullet inserted therein, said case being carried by the case holder of the ram of the press, said ram being in a raised, operable position, said bullet and case being of the same size and type as the sized, loaded ammunition case that is to be taper crimped; locking the device to the die body, and removing the case with inverted bullet from the case holder. Next, a calibrated tapered crimp is imposed upon a reloaded case by performing the steps of: threading a die regulating device onto the first end of the die body until a designated zero index portion thereof is facing toward a designated zero taper position; locking the regulating device to the first end of the die body; placing a sized, loaded ammunition case into the case holder; rotating the regulating device from the zero taper position through a sufficient number of index positions of the regulating device to achieve a desired taper crimp, thereby causing the die body to rotate correspondingly and to advance into the threaded bore of the head of the press; placing a sized, loaded case onto the case holder of the press; and raising the ram of the press to an operable position to force the mouth of the cartridge inside an annular, tapered portion of the die body, thereby imposing a tapered crimp upon the case mouth.

BRIEF DESCRIPTION OF THE DRAWINGS

Like numerals refer to like component parts of the invention throughout the several views.

DESCRIPTION OF A PREFERRED EMBODIMENT

Figure 1:
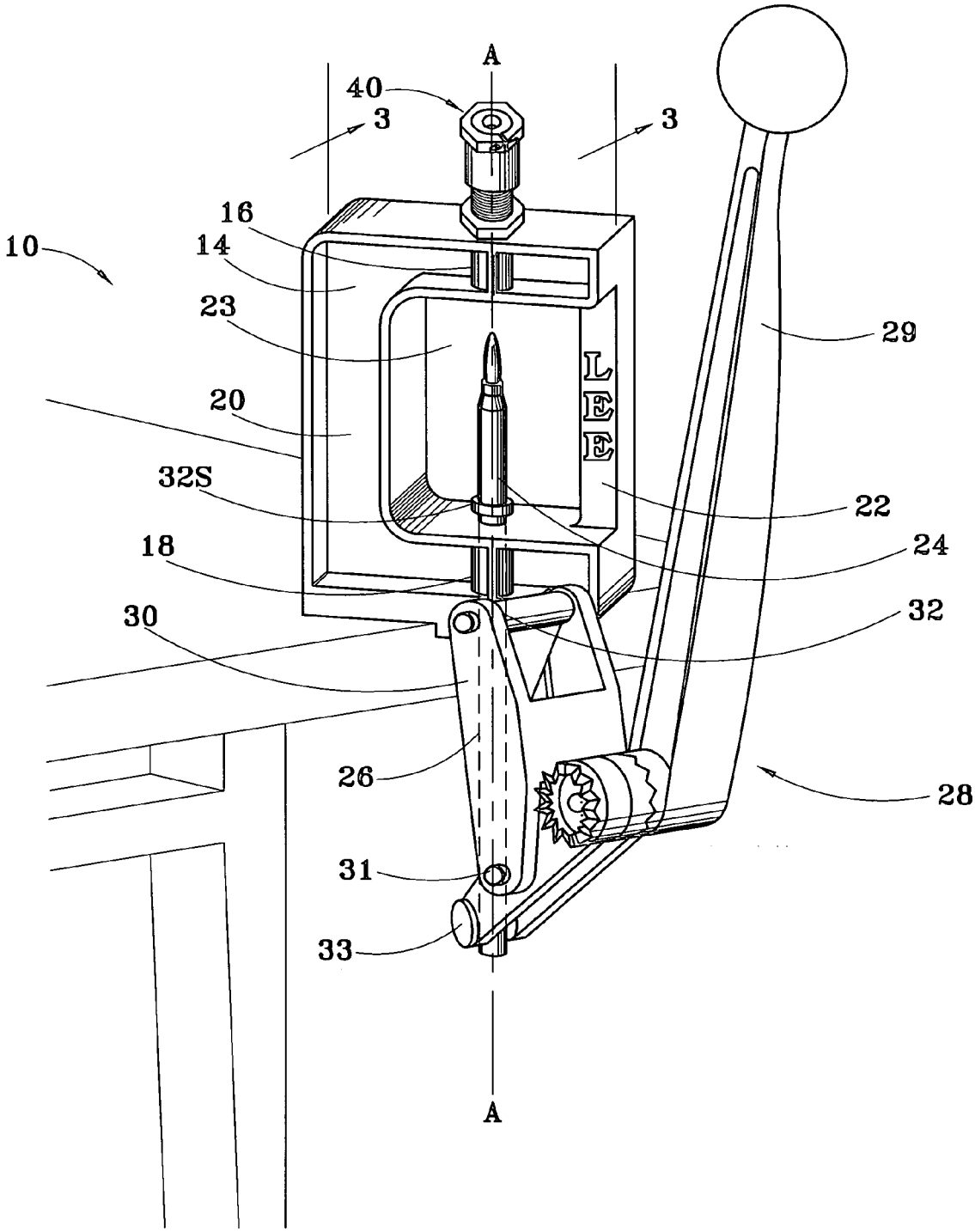
FIG. 1 is a side perspective view of an ammunition case calibrated taper crimp die installed on the ram of a reloader press together with a case that has been sized, primed, filled with powder and seated with a bullet and which is aligned for being pushed into the calibrated taper crimp die by means of the ram.
Figure 2:
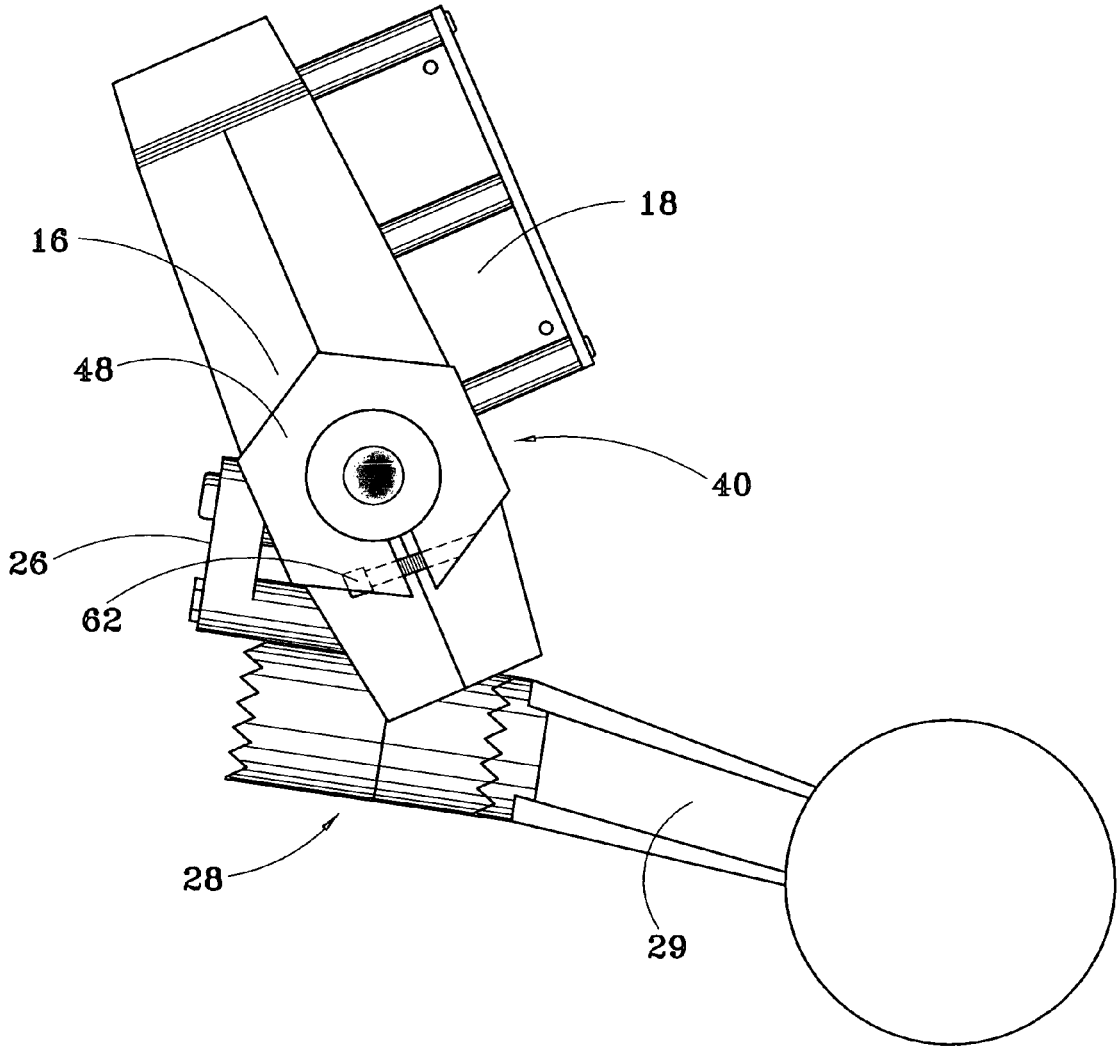
FIG. 2 is a top view thereof.
Figure 3:
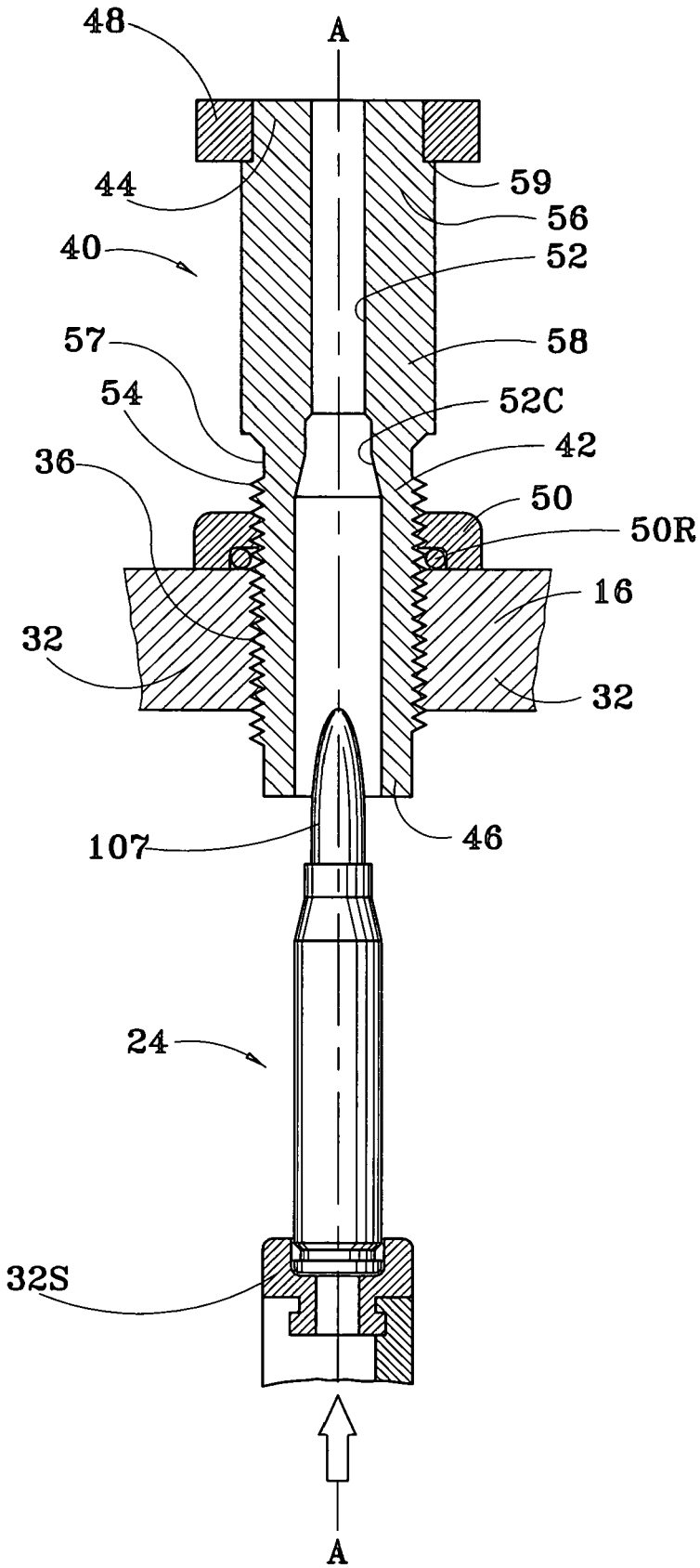
FIG. 3 is an enlarged, longitudinal cross-section taken along line 3-3 of FIG. 1.

FIGS. 1-3 illustrate a reloading press 10 in which my ammunition case calibrated taper crimp die 40 can be used. This particular press is a Lee "O" Frame Press (Lee Precision, Inc., Hartford, Wis.), but my die can be used with a variety of commercially available presses. The press in FIG. 1 comprises a body 14 having a die holder 16 and base 18 portions joined by left and right side members 20, 22, thereby defining an open space 23. A link 26 depends from the base 18 to which said link is pivotally attached. A handle assembly 28 includes a handle 29, an oppositely directed clevis 30, and a first pivot pin 31 intermediate the handle 29 and clevis 30 that pivotally attaches the handle assembly 28 to the link 26. A ram 32, shown in phantom outline in FIG. 1, is disposed within the clevis 30 to which it is pivotally connected at a lower end by a second pivot pin 33. The ram 32 extends upward through a bore (not shown) in the base 18 into the space 23. An upper end of the ram 32 includes a shell holder 32S for attaching an ammunition case 24 to the ram 32. The die holder 16 has a threaded bore 36, aligned on a common axis A-A with the ram 32, into which is threaded my die 40. Downward movement of the handle 29 moves the ram 32 upward, thereby forcing the ammunition case into the die 40 and imposing a tapered crimp on the case, as more fully described below.

As may best be seen in FIG. 3, in a first embodiment my die 40 includes an elongated, generally cylindrical die body 42 having a first end 44 and an opposite, second end 46, index means 48 in the form of a hexagonal ring, and a lock ring 50. Adjacent to the first end 46 is an enlarged-diameter, bullet-receiving portion 56 that provides a shoulder 59 for support of the index means 48 when mounted on the first end 44. Intermediate the bullet-receiving portion 56 and the second end 46 is a reduced-diameter neck portion 57. A die bore 52 extends from the first end 44 to the second end 46. The second end portion of the die bore 52 has an internal diameter slightly larger than the case 24 that is to be taper crimped. Within the neck portion 57, the die bore 52 has a constricted region 52C that is inwardly-tapered toward the first end 44 and away from the second end 46. The die body 42 has an external thread 54 for mounting within the internal thread 36 of the die holder 16. The lock ring 50 is an annular ring within an internal thread that mates with the external thread 54 of the die body 42. When the lock ring 50 is threaded onto the die body 42 to a position intermediate the tapered constriction 52C and the second end 46, a Neoprene O ring 50R within the lock ring 50 is compressed, thereby locking the lock ring 50 in position against the die holder 16 and the die body 42. Thereafter, the die 40 may be advanced through the die holder bore 36 only to said position.

Figure 4:
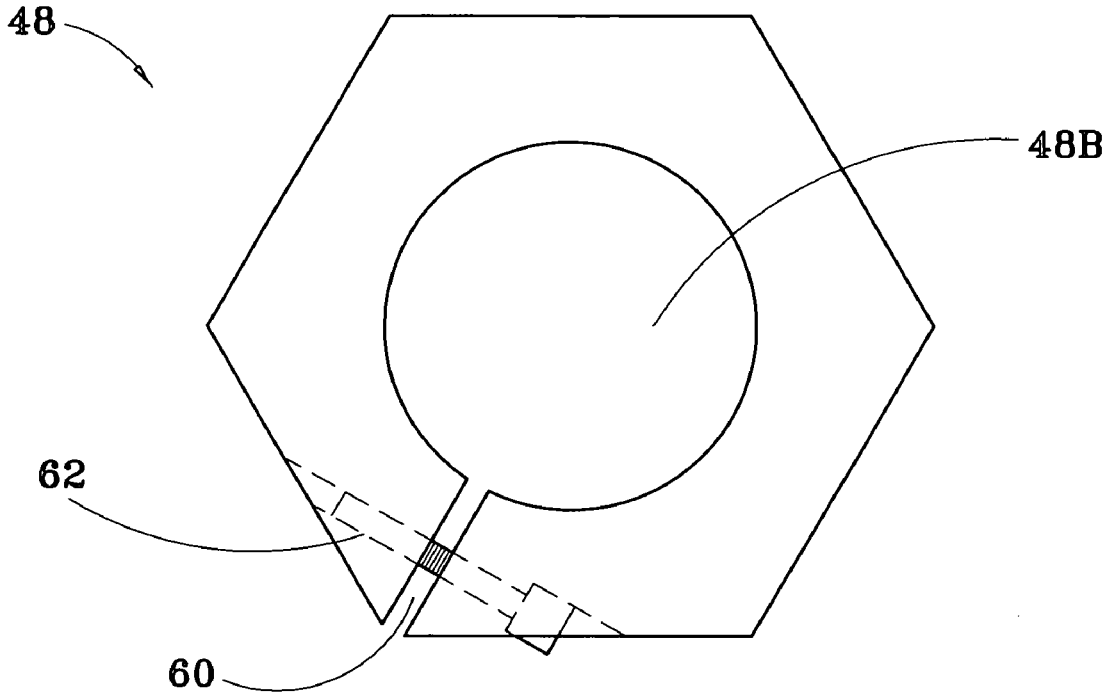
FIG. 4 is a top plan view of a regulating device having hexagonal faces.
Figure 5:
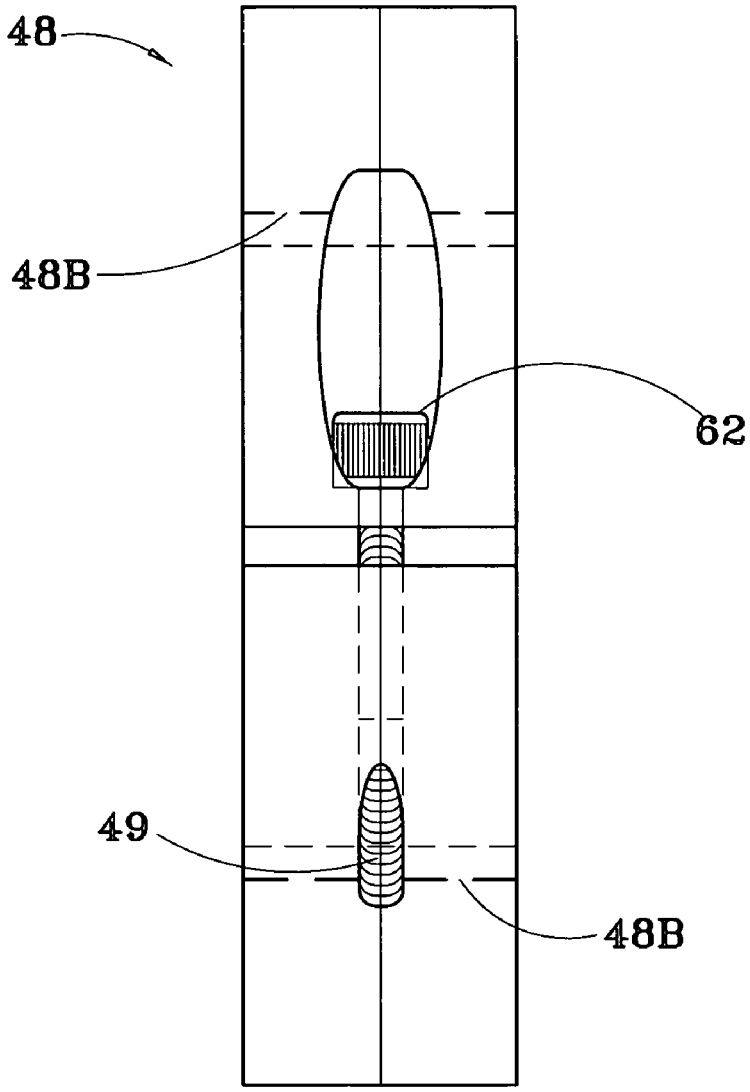
FIG. 5 is a side elevational view thereof.

As may be seen in FIGS. 4 and 5, in this first embodiment the index means 48 is a flat, solid hexagonal ring having a central bore 48B adapted to receive the first end 44 of the die body for rotatable mounting of the index means thereon. A radially-directed slot 60 is cut through one corner portion of the index means 48. A transverse set screw 62; shown in phantom outline, spans said slot and is disposed within a transversely-directed, threaded bore 49. In this embodiment, the external threads of the die body 42 have seven-eighths inch diameter and fourteen threads per inch (⅞×14), and the annular tapered portion has 0.084 taper per inch (0.084 TPI).

Figure 6:
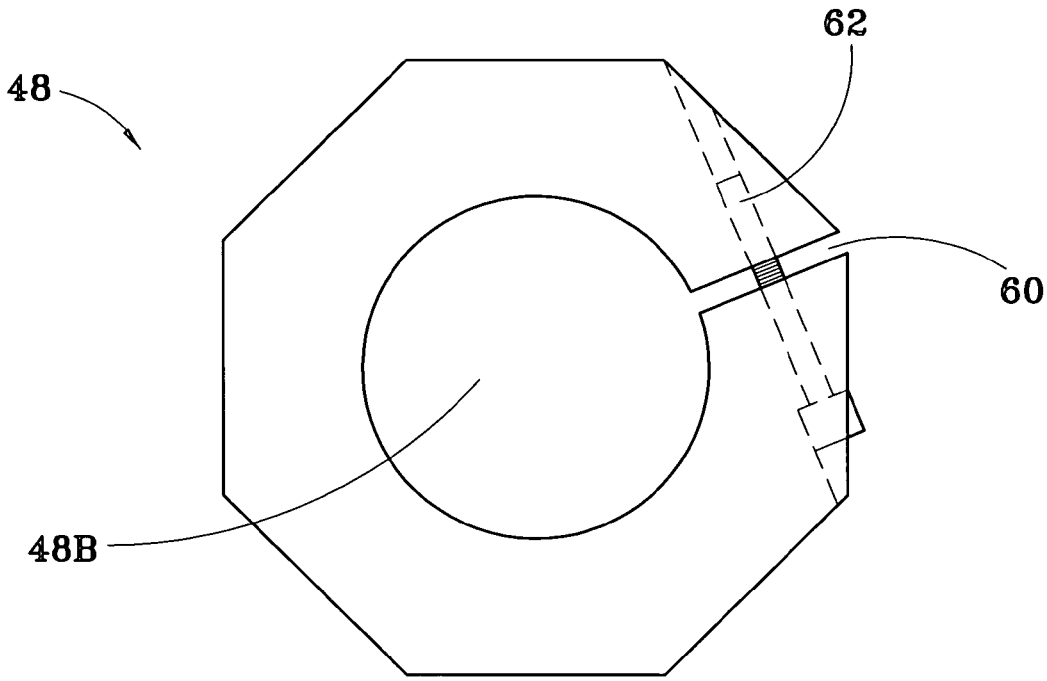
FIG. 6 is a top plan view of a regulating device having octagonal faces.
Figure 7:
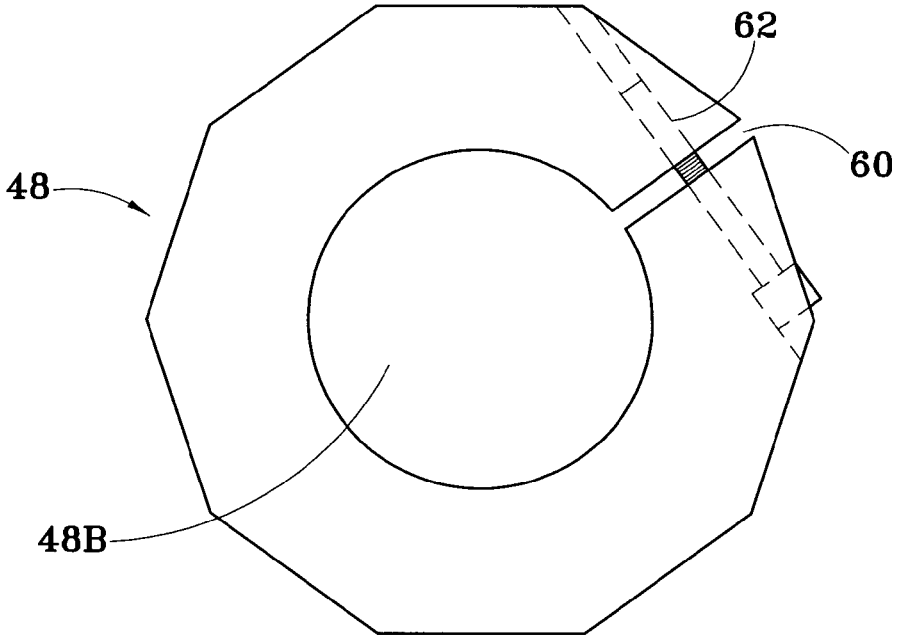
FIG. 7 is a top plan view of a regulating device having decagonal faces.
Figure 8:
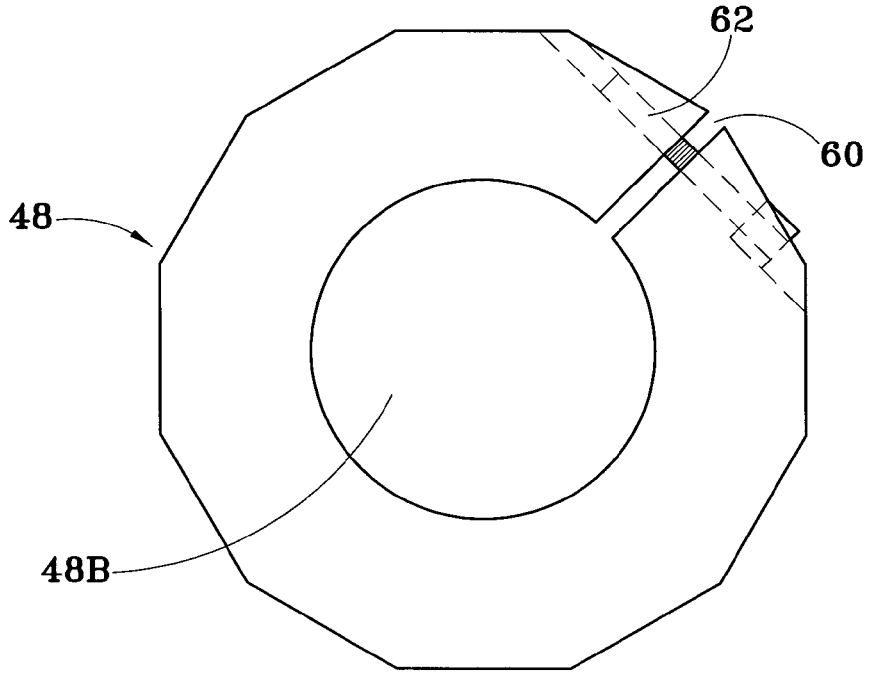
FIG. 8 is a top plan view of a regulating device having dodecagonal faces.
Figure 9:
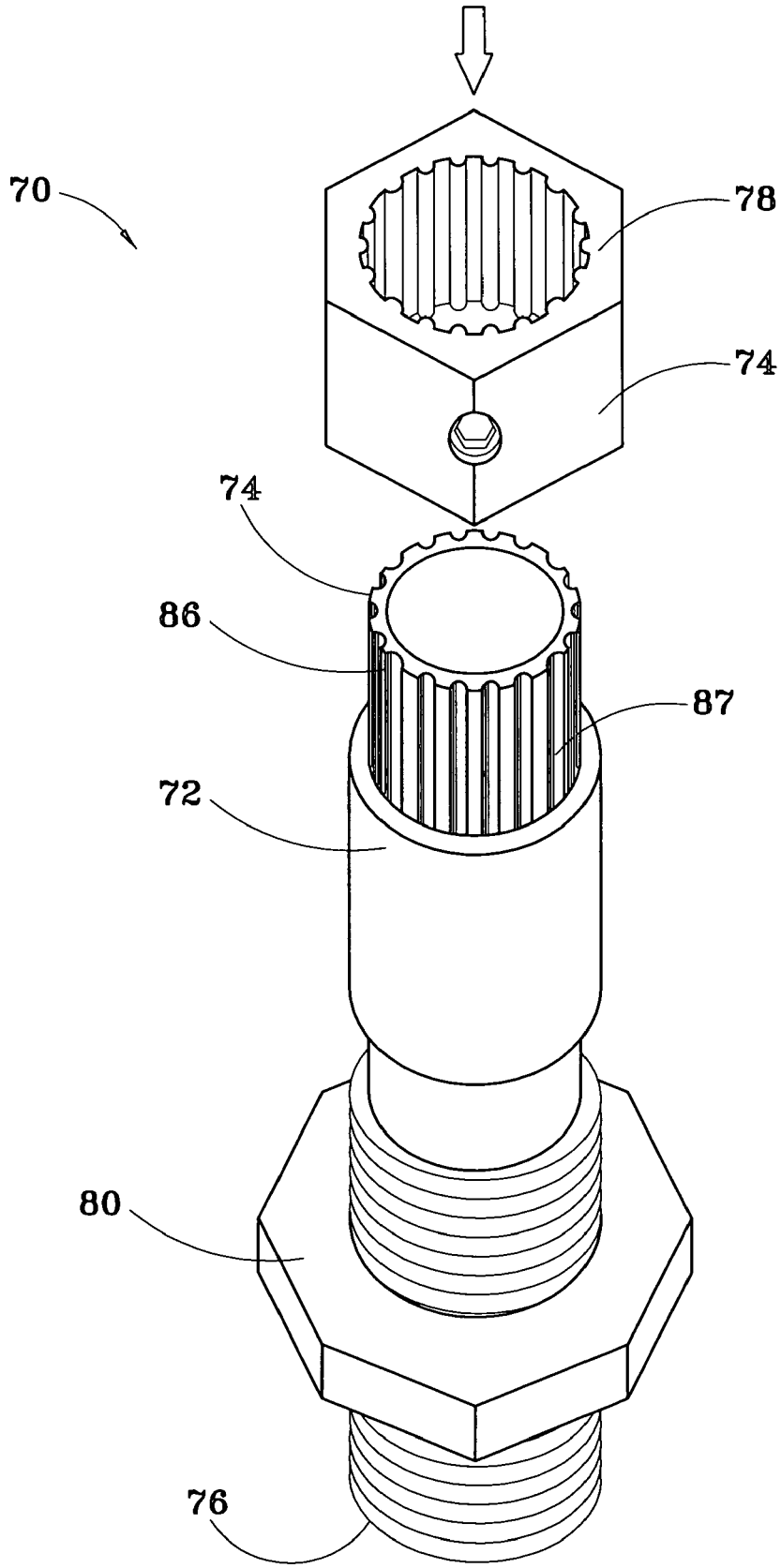
FIG. 9 is a top perspective view of a regulating device removed from the die, in the form of a cylindrical spline having twelve grooves.
Figure 10:
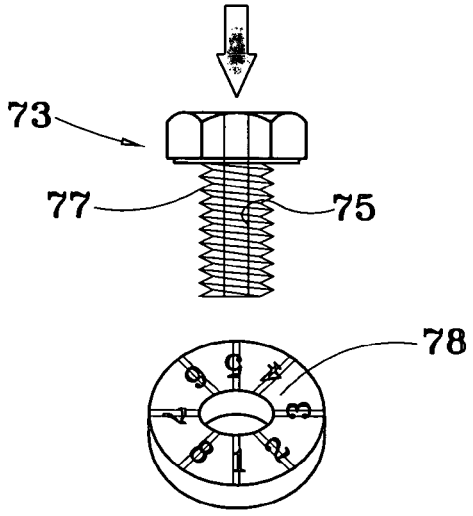
FIG. 10 is a top perspective view of a regulating device removed from the die in the form of a disk having radial grooves.
Figure 11:
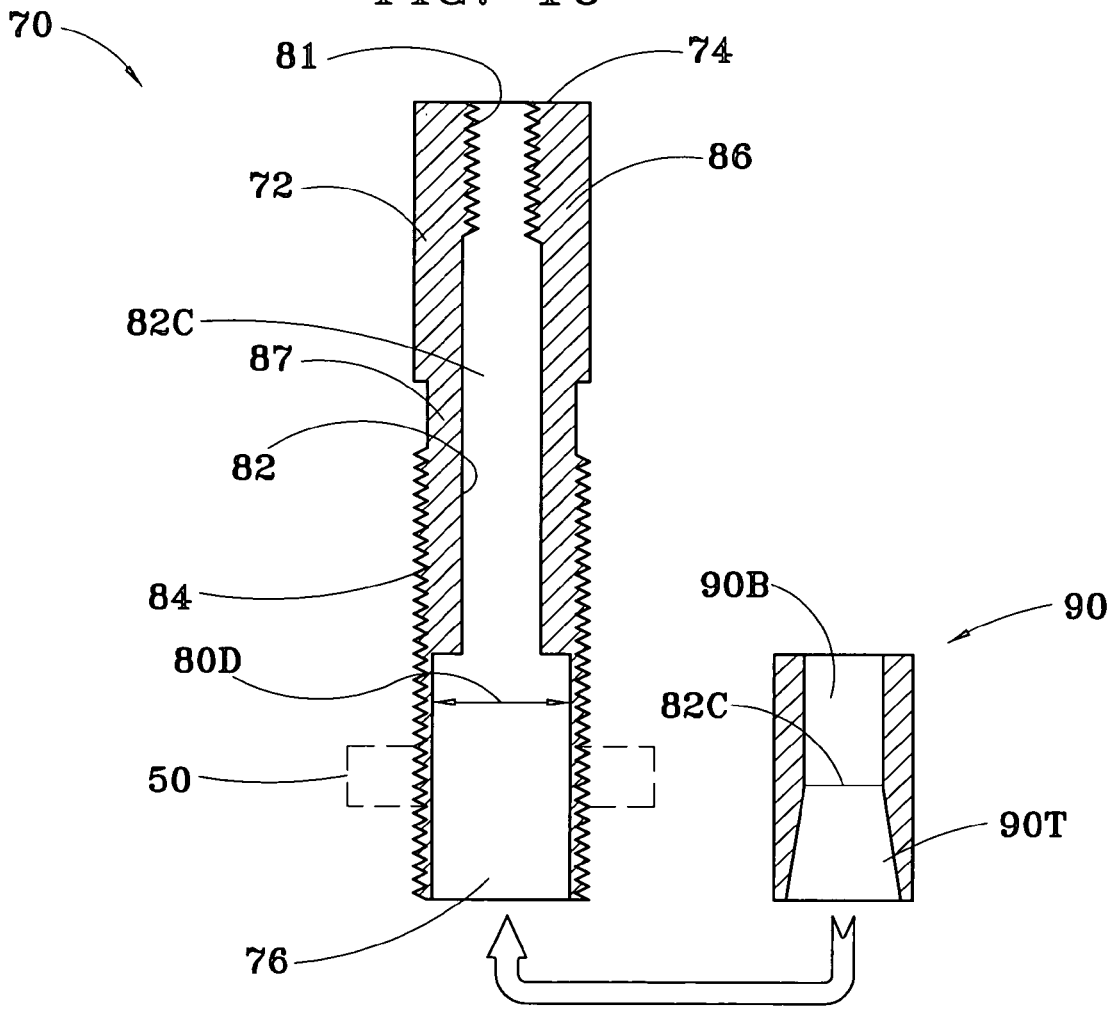
FIG. 11 is a fragmentary, vertical cross-sectional view of a lower portion of an alternative embodiment of the die that includes an insert within the bore thereof.
Figure 12:
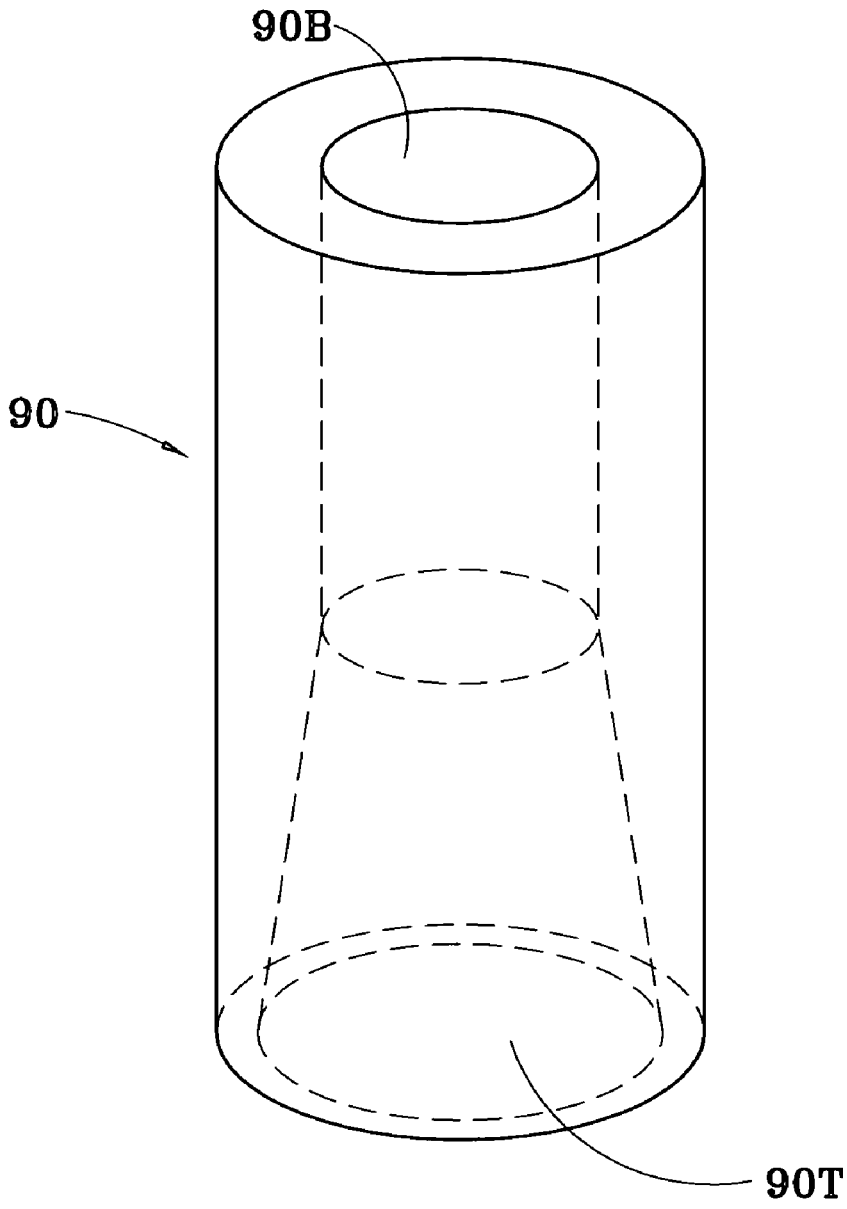
FIG. 12 is a top perspective view of the insert of FIG. 11 with the tapered bore thereof shown in phantom outline.

As may be seen in FIG. 6, in a second embodiment the index means 48 is a ring identical to that of the first embodiment except that it has an octagonal periphery. In this octagonal ring embodiment, the external threads of the die body 42 have seven-eighths inch diameter and fourteen threads per inch (⅞×14), and the annular tapered portion has 0.112 taper per inch (TPI). FIG. 7 illustrates a third embodiment wherein the index means 48 is a decagonal (10-sided) ring for which the external threads of the die body 42 have seven-eighths inch diameter and fourteen threads per inch (⅞×14), and the annular tapered portion has 0.140 taper per inch (0.140 TPI). FIG. 8 illustrates a fourth embodiment wherein the index means 48 is a dodecagonal (12-sided) ring for which the external threads of the die body have seven-eighths inch diameter and fourteen threads per inch (⅞×14), and the annular tapered portion has 0.168 taper per inch (0.168 TPI).

FIGS. 9-12 illustrate a fifth embodiment 70, which includes an elongated, generally cylindrical die body 72 having a first end 74 and an opposite, second end 76, index means 78, and a lock ring 80. A bolt 73 mounts an index means 78 having a threaded, central bore to an internal thread 81 of the first end 74. The bolt 73 has an axially-directed vent bore 75. Intermediate a bullet-receiving portion 86 and the second end 76 is a reduced-diameter neck portion 87. A die bore 82 extends from the first end 74 to the second end 76. Within the neck portion 87, the die bore 52 has a constricted region 82C that is inwardly-tapered toward the first end 74 and away from the second end 76. The die body 72 has an external thread 84 for mounting within the internal thread 36 of the die holder 16. The lock ring 50 is an annular ring with a set screw (not shown) and an internal thread that mates with the external thread 84 of the die body 72. When the lock ring 50 is threaded onto the die body 72 to a position intermediate the tapered constriction 82C and the second end 76, and the set screw is tightened, the die 70 may be advanced through the die holder bore 36 only to said position. The second end portion of the die bore 52 has an enlarged internal diameter for receiving a permanent insert 90, depicted in FIGS. 11 and 12. The insert 90 has an axial bore 90B that tapers inwardly from the second end 76 toward the first end 74 of the die body 72. In this fifth embodiment, the tapered portion 90T of the insert 90 is used to impose a taper crimp upon a case 24.

Figure 13:
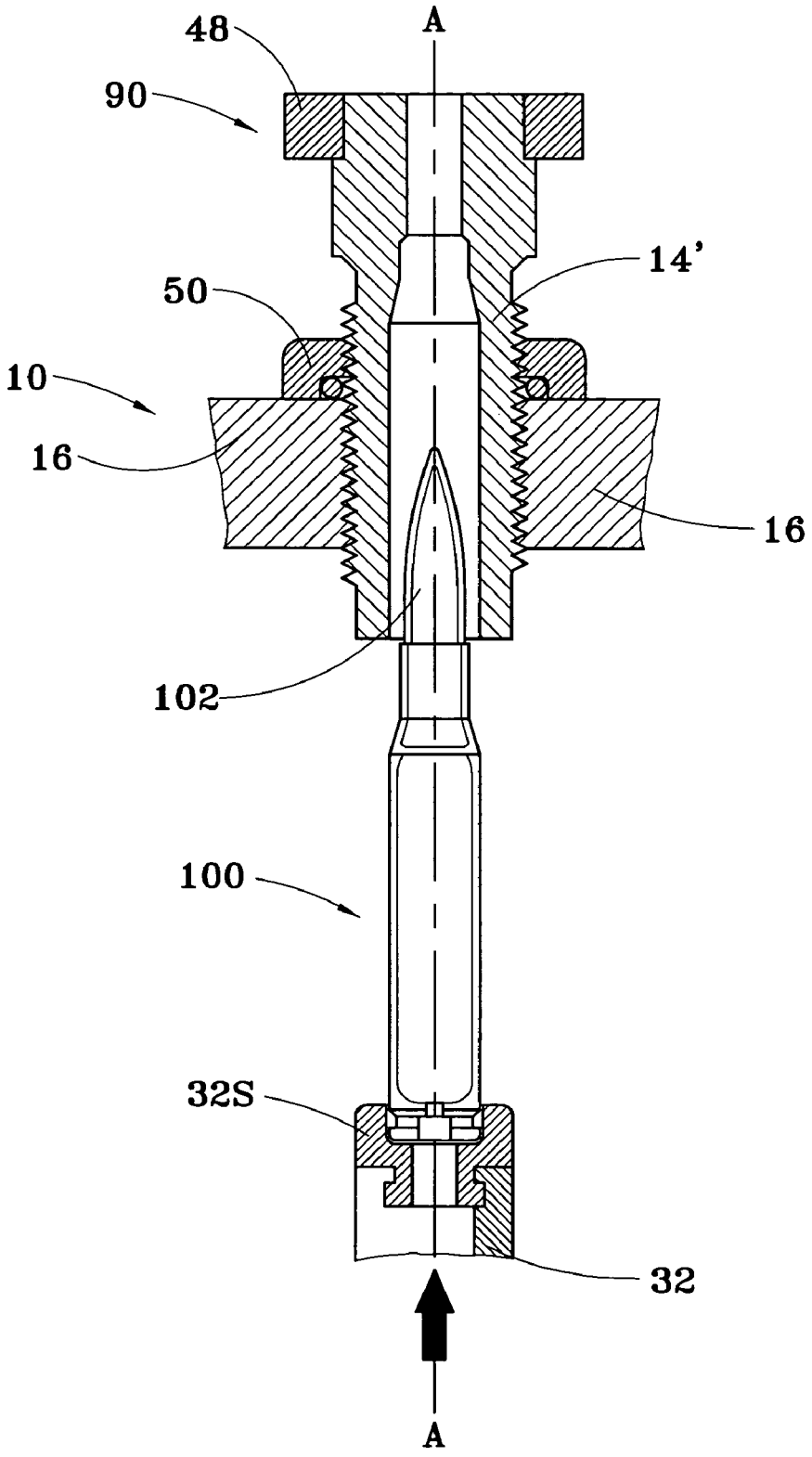
FIG. 13 is a vertical sectional view through a .50 caliber, BMG ammunition case calibrated taper crimp die installed in a fragmentarily shown part of a reloader press together with a case that has been sized, filled with powder and seated with a bullet and which is aligned for being pushed into the calibrated taper crimp die by means of the fragmentarily shown part of the ram on which the case is mounted.

A sixth embodiment of my calibrated taper crimp die is adapted for imposing a tapered crimp on a .50 Cal. BMG ammunition case. FIG. 13 is a longitudinal section of such a die 90 installed in a fragmentarily shown part of a reloader press 10 together with a .50 caliber BMG case 100 that has been sized, filled with powder and seated with a bullet 102 that is aligned on axis A-A for being pushed into the calibrated taper crimp die 90 by means of the fragmentarily shown part of the ram 32 on which the case 100 is mounted. As in the above-described embodiments, this die 90 includes a die body 14', regulating ring 48, and a locking ring 50, all substantially as described above; provided that, the internal bore 52' of the die body 14' is lengthened compared to the die body 14 of the above-described embodiments, and is contoured to match the external shape of the .50 Cal. BMG case 100 and bullet 102.

A seventh embodiment of my die assembly is adapted for imposing a tapered crimp on a 20 mm Lahti ammunition cartridge. The components, configuration and appearance of this embodiment are substantially similar to those shown and described in FIG. 13 for crimping a .50 Cal. BMG cartridge.

Figure 14:
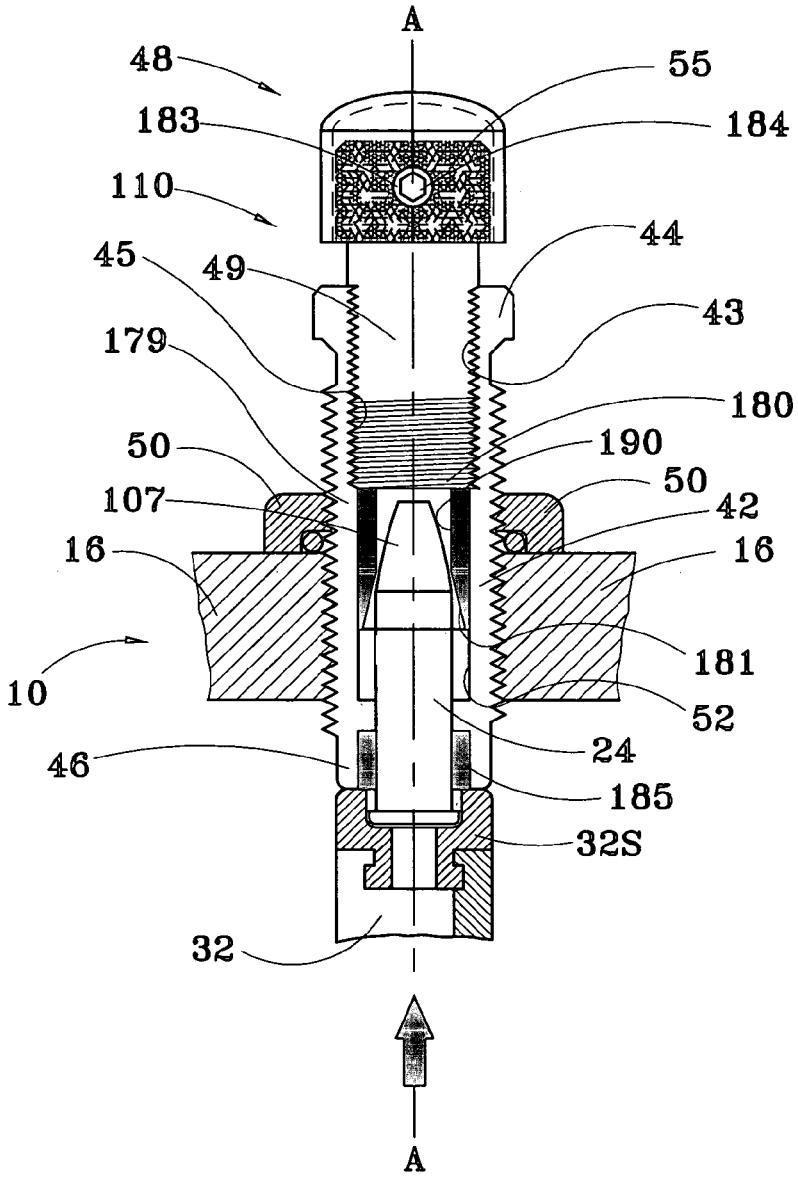
FIG. 14 is a vertical sectional view through a Lee Carbide Factory Crimp die in a fragmentarily shown part of a reloader press together with a case that has been sized, filled with powder and seated with a bullet and which is aligned for being pushed into the calibrated taper crimp die by means of the fragmentarily shown part of the ram on which the case is mounted.
Figure 15:
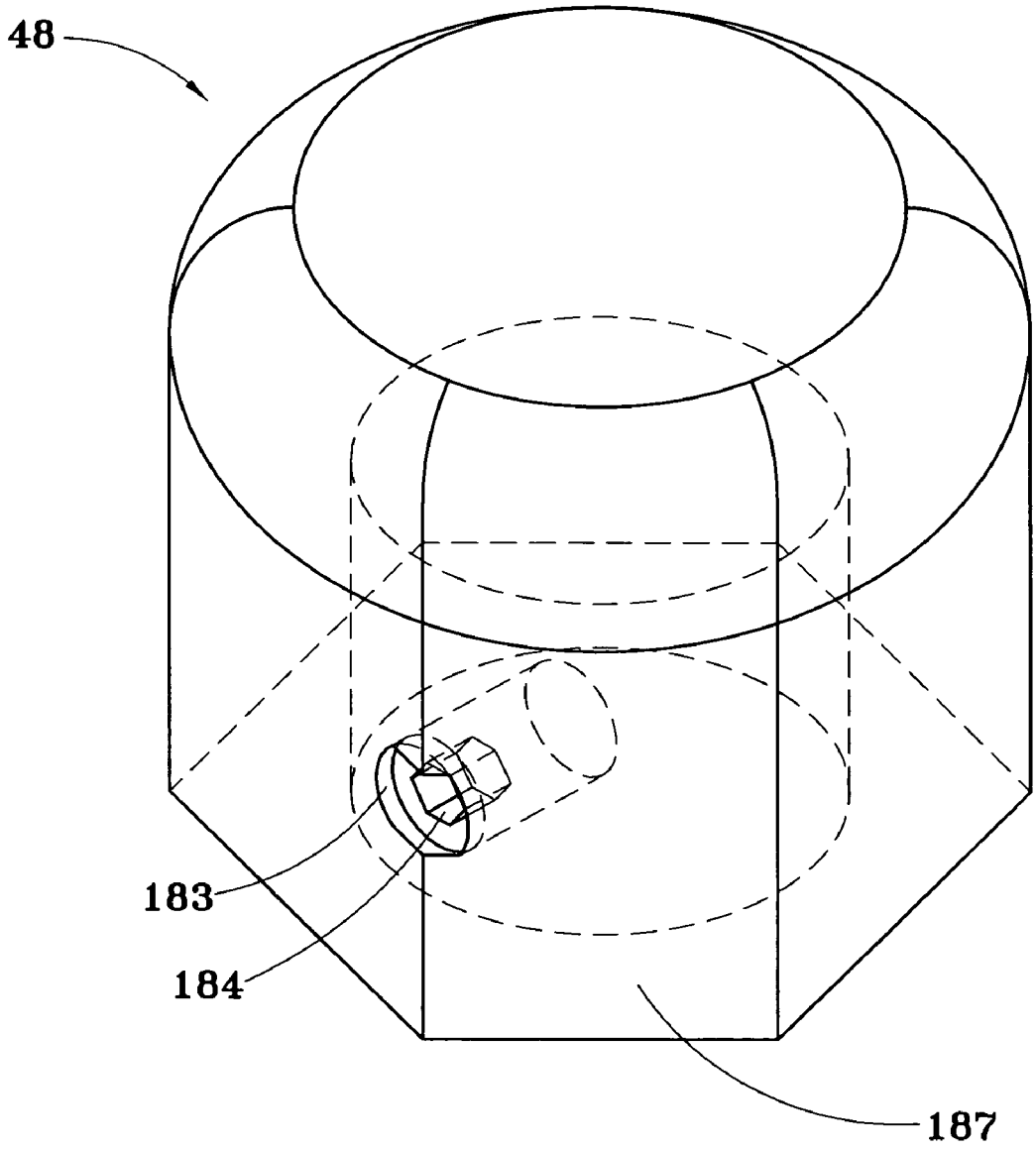
FIG. 15 is a top perspective view of the regulating device thereof removed from the die.
Figure 16:
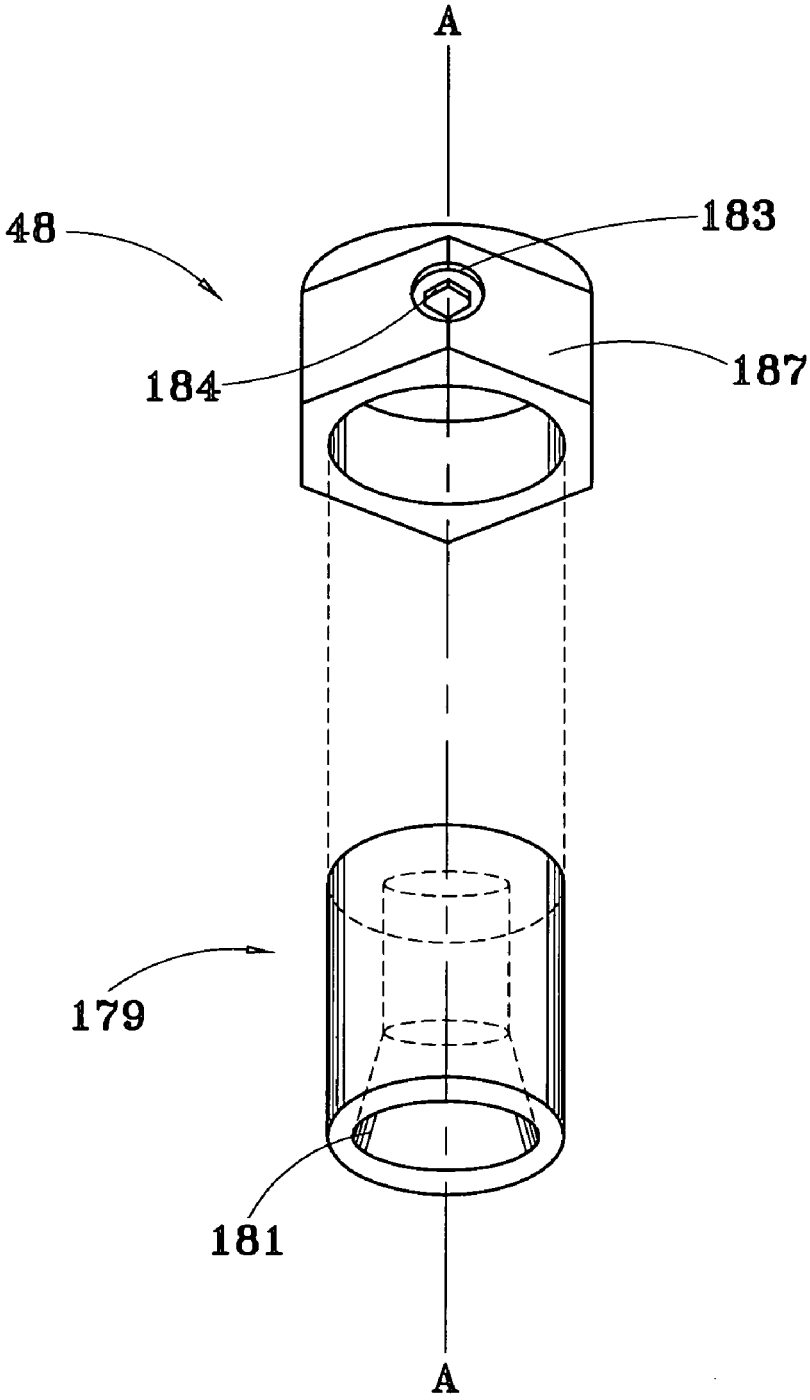
FIG. 16 is an elevational, perspective view of the Lee Carbide Factory Crimp die modified according to the present invention, with all portions thereof deleted for clarity except the regulating device and the floating crimper.

U.S. Pat. No. 4,385,546 to Richard J. Lee describes and claims an ammunition casing reloader die assembly, which disclosure by this reference is incorporated herein. The assembly includes a bullet crimper that is provided with a capped adjusting screw in which the bullet crimper element floats so that it adjusts itself into alignment when a bullet on a casing is rammed into it. In an eighth embodiment of my calibrated taper crimp die, the Lee Carbide Factory Crimp die is modified to include a regulating cap together with a modification to the crimping angle, as explained below. FIG. 14 is a vertical cross-section through a Lee Carbide Factory Crimp die 110 in a fragmentarily shown part of a reloader press 10 together with a case 24 that has been sized, filled with powder and seated with a bullet that is aligned for being pushed into said die by means of the fragmentarily shown part of the ram 32 upon the shell holder 32S on which the case 24 is mounted. The Lee die 110 includes an elongated, generally cylindrical die body 42 having a first end 44 and an opposite, second end 46, and a bore 52 extending from the first end 44 to the second end 46. An upper half of the bore 52 has an internal thread 43 to which is matingly engaged an external thread 45 of a generally cylindrical crimp adjustment screw 49 that terminates at a top end thereof in a knurled knob 55. The adjustment screw 49 has a smooth, axially extending cylindrical hole 190 that is closed by a top wall and is open at the bottom. Captured within a lower portion of the central hole 190 of the adjustment screw 49 is a floating bullet crimper 179 adapted to float to align itself with the bullet 107. A lower portion of the floating crimper 179 has a conical recess adapted to rest upon and receive the bullet end of the case 24 and includes an internal crimper 181 for imposing a taper crimp upon said case. The outside diameter of the floating crimper 179 is slightly less than the inner diameter of the central hole 190, which allows for the floating crimper to shift laterally to obtain alignment with the bullet 107. By freely floating, the floating crimper 179 equilibrates the crimping force about the periphery of the mouth of said case; and, rotational adjustment of the crimp adjustment screw 49 controls the degree of crimp imposed upon the mouth of the case 24. Within the second end 46 of the die body 42 is a carbide finish sizing element 185 that reduces any oversize, external portion of a cartridge assembly to fit within a standard firearm chamber. Here described thus far are standard aspects and features of the Lee Carbide Factory Crimp die. In order to better calibrate and control the crimp imposed on a case 24, I have modified said die 110 in the following ways: Index means 48 in the form of a regulating cap is placed over the knurled knob 55, said cap having a recess to receive said knob and a threaded aperture 183 for threaded insertion of a set screw 184, securing the cap thereto. A lower portion of the cap 48 has an annular, hexagonal periphery 187 to serve as indicia of rotational adjustment of the cap 48 and a rotational adjustment screw 49. FIGS. 15 and 16 illustrate such a hexagonal cap 48 for use with said die 110, although an octagonal cap may also be used. A further modification is also required to the standard Lee Carbide Factory Crimp die: for a hexagonal cap 48, the floating crimper 179 should have an internal taper 181 of 0.108 taper per inch (TPI); and, for an octagonal cap 48, the floating crimper 179 should have an internal taper 181 of 0.144 inch taper per inch (TPI).

Various changes and modifications will become obvious to those skilled I the art. It is the intent that these changes and modifications are to be encompassed within the spirit of the appended claims and that the invention described herein and shown in the accompanying drawings is illustrative only and not intended to limit the scope of the invention.

The invention claimed is:

1. A modified Lee Precision Carbide Factory Crimp die, including a generally cylindrical die body having first and second ends, a bore extending from the first end to the second end and having an internal thread extending from the first end, an external thread for mounting within internal threads of a die holder of an ammunition reloading press, a lock ring adapted for threading onto the die body, and a crimp adjuster screw mounted on said first end of the die body, said crimp adjuster screw having a lower portion with external threads in mating engagement with the internal threads of the bore and an upper portion that terminates in a knurled knob, and wherein inserted into a lower portion of said bore in said die is a floating crimper having an annular tapered portion against which the mouth of the case is pressed when the case is pressed far enough into the die body to impose a crimp on the mouth of the case, said crimp adjuster screw being engageable with said floating crimper for adjusting the position of the floating crimper within the bore, further comprising index means attached to said knurled knob for manually regulating and calibrating the degree of crimp to be imposed on a sized and loaded ammunition case, wherein the index means includes a regulating cap having peripherally-disposed indicia of rotation and means to secure the regulating device to the knurled knob, and the taper per inch of the floating crimper is according to either of the following possibilities:

means for indicia comprising hexagonal faces and crimp adjuster screw having 18 threads per inch and ⅝ inch diameter, the floating crimper has 0.108 TPI or 0.216 TPI or 0.324 TPI;

means for indicia comprising octagonal faces and crimp adjuster screw having 18 threads per inch and ⅝ inch diameter, the floating crimper has 0.144 TPI or 0.288 TPI or 0.432 TPI.

2. The modified Lee Carbide Factory Crimp die of claim 1, wherein the means to secure the regulating cap to the knob includes a set screw inserted through a threaded aperture in the regulating cap and directed toward said knurled knob.

3. A method of using the ammunition case reloading die assembly of either of claims 1 or 2 in conjunction with an ammunition reloading press to impose a calibrated, tapered crimp on the mouth of a sized, loaded ammunition case, comprising the steps of:

(a) creating a gauge cartridge by performing the steps of:

(1) selecting an empty case of the size and type of the case that is to be reloaded;

(2) full-length sizing and depriming the selected case; and (3) seating a bullet of size and type corresponding to the case, said bullet being inverted within the mouth of the case, leaving a sufficient length of the bullet protruding through the case mouth to support the case mouth;

(b) establishing a zero point position for the die body by performing the steps of:

(1) threading the lock ring onto a lower portion of the die body and on up to an upper, threaded portion of the die body;

(2) lowering the ram;

(3) mounting the gauge body to the case holder of the ram of the press;

(4) raising the ram of the press to a raised, operable position;

(5) holding the lock ring stationary while threading the die body into a threaded bore of an ammunition case reloading press, said bore aligned with the gauge body, until the second end of the die body just contacts the gauge cartridge, said bullet and case being of the same size and type as the sized, loaded ammunition case that is to be taper crimped, (6) threading the lock ring down the die body until the lock ring snugly contacts the press, (7) securing the lock ring to the die body, (8) rotating the regulating device so that a designated zero index of the indicia thereon points to a predetermined zero index position and then securing the regulating device to the die body, (9) lowering the ram, and

(10) removing the gauge cartridge from the case holder; and (c) imposing a regulated and calibrated, taper crimp upon a resized, reloaded ammunition case by performing the steps of (1) loosening the lock ring and backing the lock ring off to create clearance between the lock ring and the press, (2) rotating the die assembly from the zero index position through a sufficient number of index positions to achieve a desired taper crimp, (3) snugly screwing the lock ring down to the press and securing the lock ring to the die body, (4) placing a resized, reloaded case onto the case holder of the press, (5) raising the ram of the press to an operable position to force the mouth of the resized, reloaded case inside the annular tapered portion of the die body, thereby imposing a tapered crimp upon the mouth of said case, and (6) lowering the ram and removing the taper crimped cartridge from the case holder.

* * * * *